US009105248B2

(12) United States Patent
Um et al.

(10) Patent No.: US 9,105,248 B2
(45) Date of Patent: Aug. 11, 2015

(54) ARRAY SUBSTRATE, DISPLAY DEVICE AND METHOD FOR DRIVING PIXELS WITHIN EACH PIXEL REGION OF THE ARRAY SUBSTRATE

(71) Applicant: BOE TECHNOLOGY GROUP CO., LTD., Beijing (CN)

(72) Inventors: Yoon-Sung Um, Beijing (CN); Hyun-Sic Choi, Beijing (CN); Zhiqiang Xu, Beijing (CN); Hui Li, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 53 days.

(21) Appl. No.: 14/071,823

(22) Filed: Nov. 5, 2013

(65) Prior Publication Data

US 2014/0125571 A1 May 8, 2014

(30) Foreign Application Priority Data

Nov. 5, 2012 (CN) ..... 2012 1 0436331

(51) Int. Cl.
*G09G 3/36* (2006.01)

(52) U.S. Cl.
CPC ..... *G09G 3/3614* (2013.01); *G09G 2300/0426* (2013.01); *G09G 2320/0233* (2013.01)

(58) Field of Classification Search
CPC ..... G09G 3/36; G09G 3/3611
USPC ..... 345/87, 100
See application file for complete search history.

(56) References Cited

U.S. PATENT DOCUMENTS 7,623,090 B2 * 11/2009 Ijzerman et al. ..... 345/32
8,159,429 B2 * 4/2012 Kim et al. ..... 345/87

(Continued)

FOREIGN PATENT DOCUMENTS

CN 101726893 A 6/2010
CN 101893796 A 11/2010

(Continued)

OTHER PUBLICATIONS

Chinese First Office Action Dated Aug. 29, 2014, Applicant BOE Technology Group Co., Ltd., Application No. 201210436331.0, 9 Pages.

*Primary Examiner* — Roy Rabindranath
(74) *Attorney, Agent, or Firm* — Brooks Kushman P.C.

(57) ABSTRACT

Embodiments of the present disclosure provide an array substrate comprising a plurality of gate lines, a plurality of data lines, and pixel regions each of which is defined by intersecting one gate line and two neighboring data lines among the plurality of gate lines and the plurality of data lines wherein two thin film transistors (TFTs) are formed at the intersections between the gate line and the two neighboring data lines in each pixel region, a first pixel electrode and a second pixel electrode are alternately arranged in each pixel region. A first thin film transistor of the two thin film transistors is coupled to the first pixel electrode, a second thin film transistor of the two thin film transistors is coupled to the second pixel electrode. The two neighboring data lines participating in defining a pixel region comprise a first data line coupling to the first thin film transistor and a second data line coupling to the second thin film transistor. Voltages having the same absolute value and opposite polarities are applied to the first pixel electrode and the second pixel electrode respectively via the first thin film transistor and the second thin film transistor.

13 Claims, 3 Drawing Sheets

(56) References Cited

U.S. PATENT DOCUMENTS

| | | | | |
|---|---|---|---|---|
| 8,289,310 | B2 * | 10/2012 | Lee et al. | 345/212 |
| 8,427,594 | B2 | 4/2013 | Kim et al. | |
| 8,669,973 | B2 | 3/2014 | Sakurai et al. | |
| 2007/0115234 | A1 | 5/2007 | Kim et al. | |
| 2009/0262054 | A1 * | 10/2009 | Hsu et al. | 345/87 |
| 2009/0262106 | A1 * | 10/2009 | Lu et al. | 345/214 |
| 2012/0249907 | A1 | 10/2012 | Kimura | |

FOREIGN PATENT DOCUMENTS

| | | | |
|---|---|---|---|
| CN | 102292666 | A | 12/2011 |
| KR | 1020090015737 | | 2/2009 |
| KR | 1020110000823 | | 1/2011 |

* cited by examiner

ARRAY SUBSTRATE, DISPLAY DEVICE AND METHOD FOR DRIVING PIXELS WITHIN EACH PIXEL REGION OF THE ARRAY SUBSTRATE

CROSS-REFERENCE TO RELATED APPLICATIONS

The present application claims priority to and incorporates by reference the entire contents of Chinese priority document 201210436331.0, filed in China on Nov. 5, 2012.

TECHNICAL FIELD

This invention relates to a liquid display field, and more particularly to an array substrate, a display device and a pixel driving method.

BACKGROUND

In the display technical field, an Advanced Super Dimension Switch (ADS) technique may improve picture quality of a thin film transistor-liquid crystal display (TFT-LCD) product. It has advantages of high definition, high transmissivity, low power consumption, wide viewing angle, high aperture ratio, low chromatic aberration, and no push Mura. Therefore, such technique is widely used in various display products. The ADS technique is a core technique for having a flat electric field and a wide viewing angle, that is, a multi-dimensional electric field is formed by an electric field produced by edges of slit electrodes in the same panel and an electric field produced between a slit electrode layer and a plate electrical layer, so that all orientation liquid crystal molecules between slit electrodes in a liquid crystal cell and over the electrodes may result in a rotation, so as to improve the operation efficiency of the liquid crystal and increase the transmissivity. The ADS technique may improve the picture quality of a TFT-LCD product. A triple field switching (TFS) mode reflects the improvement on the ADS technique; it has the advantages of small pixel capacitance and high transmissivity. The TFS mode may be regarded as a New ADS mode. Within the pixel regions in the TFS mode, any one pixel region is formed by intersection of a gate line and two data lines, which is a 1G2D structure. In normal conditions, the data lines in the pixel region is coupled to a source electrode; a driving circuit applies a voltage to the data lines; and the data lines transfer signals to a pixel electrodes via a TFT switch. However, as for the array substrate in the new TFS mode, two data lines generate coupling capacitance with pixel electrode respectively. For two data lines having the same voltage, the coupling capacitance between the data lines and the pixel electrodes is a sum of the coupling capacitance between one of the two data lines and the pixel electrode plus the coupling capacitance between the other data line and the pixel electrode. Since there are coupling capacitances, the signal transmitted to the pixel electrode by the data lines has a certain delay, so that picture display has a problem.

SUMMARY

The technical problem to be solved by the present invention is to provide an array substrate, a display device and a method for driving pixels. Therefore, the phenomena that a jump voltage produced by a coupling capacitance between the data line and the pixel electrode leads to a non-uniform picture display is avoided.

In order to solve the above technical problem, an embodiment of the present invention provides an array substrate, comprising: a plurality of gate lines, a plurality of data lines, and pixel regions each of which is defined by intersecting one gate line and two neighboring data lines among the plurality of gate lines and the plurality of data lines;

wherein two thin film transistors (TFTs) are formed at the intersections between the gate line and the two neighboring data lines in each pixel region, a first pixel electrode and a second pixel electrode are alternately arranged in each pixel region;

wherein a first thin film transistor of the two thin film transistors is coupled to the first pixel electrode, a second thin film transistor of the two thin film transistors is coupled to the second pixel electrode;

wherein the two neighboring data lines participating in defining a pixel region comprise a first data line coupling to the first thin film transistor and a second data line coupling to the second thin film transistor; and wherein voltages having the same absolute value and opposite polarities are applied to the first pixel electrode and the second pixel electrode respectively via the first thin film transistor and the second thin film transistor.

Here, the first pixel electrode is arranged above the two neighboring data lines or the second pixel electrode is arranged above the two neighboring data lines, and the first pixel electrode or the second pixel electrode covers an orthographic projection position above the two neighboring data lines.

Here, the width of the first pixel electrode or the second pixel electrode is larger than the width of the first data line or the second data line.

Here, the width of the first pixel electrode or the second pixel electrode is 6-12 μm larger than the width of the first data line or the second data line.

Another embodiment of the present invention also provides a display device, comprising an array substrate stated above and a color filter substrate that is cell-aligned with the array substrate.

Here, a common electrode is further arranged on the color filter substrate that is cell-aligned with the array substrate.

Here, a black matrix is arranged at a corresponding position above the data lines on the color filter substrate; and wherein a width of the black matrix is 12-26 μm with respect to the corresponding position above the data lines.

Another embodiment of the present invention further provides a method for driving pixels within each pixel region of the array substrate stated above, comprising:

Step 1, applying voltages having the same absolute value and opposite polarities to the first pixel electrode and the second pixel electrode respectively.

Here, Step 1 comprises:

Step 11, obtaining a first pixel voltage and a second pixel voltage used for display of the first pixel electrode and the second pixel electrode, wherein the first pixel voltage and the second pixel voltage have the same absolute value and opposite polarities;

Step 12, determining a coupling capacitance generated by a data line and a pixel electrode;

Step 13, determining a first data line voltage and a second data line voltage to be inputted by the first data line and the second data line based on the first pixel voltage, the second pixel voltage and the coupling capacitance;

Step 14, outputting the first data line voltage and the second data line voltage determined in Step 13 to the first data line and the second data line via a driving circuit; and Step 15, driving the first pixel electrode and the second pixel electrode via the first thin film transistor and the second thin film transistor in a pixel region respectively, based on the first data line voltage and the second data line voltage.

Here, Step 12 comprises:

Step 121, determining a first coupling capacitance between the first data line and the first pixel electrode in the pixel region, based on a distance between the first data line and the first pixel electrode and the width of the first pixel electrode; and Step 122, determining a second coupling capacitance between the second data line and the second pixel electrode in the pixel region, based on a distance between the second data line and the second pixel electrode and the width of the second pixel electrode.

Here, in Step 121 or Step 122, the first coupling capacitance and the second coupling capacitance are determined by the following equation:

$$C_dp(M+2) = C_dp(M+3) = \frac{\varepsilon S}{d};$$

wherein C_dp(M+2) is the first coupling capacitance, C_dp (M+3) is the second coupling capacitance, ∈ is a dielectric constant, S is an area where a capacitor plate on which the first data line and the second data line are located is directly facing to a capacitor plate on which the pixel electrode is located, and d is a distance between the two capacitor plates.

Here, Step 13 comprises:

Step 131, determining a first voltage jump value of the first pixel electrode which is caused by the first coupling capacitance and between the first data line and the first pixel electrode;

Step 132, determining a second voltage jump value of the second pixel electrode which is caused by the second coupling capacitance and between the second data line and the second pixel electrode;

Step 133, determining a total voltage jump value of the pixel electrodes based on the first coupling capacitance, the second coupling capacitance, the first voltage jump value and the second voltage jump value; and Step 134, determining the first data line voltage and the second data line voltage to be inputted by the first data line and the second data line based on the total voltage jump value of the pixel electrodes.

Here, C_dp(M+2)=C_dp(M+3), and ΔV(M+2)=ΔV(M+3), wherein, if ΔV(M+2) is a voltage jump value which is increased for the first pixel electrode, and ΔV(M+3) is a voltage jump value which is decreased for the second pixel electrode and both of them have the same absolute value and opposite polarities.

Here, the total voltage jump value of the first pixel electrode and the second pixel electrode is determined based on the following equation:

$$Total\Delta VPixelVoltage = \frac{C_dp(M+2)}{C_lc + C_gs} \times \Delta V(M+2) + \frac{C_dp(M+3)}{C_lc + C_gs} \times \Delta V(M+3) = 0$$

wherein, totalΔVPixelVoltage is the total voltage jump value of the first pixel electrode and the second pixel electrode, C_lc is a liquid crystal capacitance, C_gs is a parasitic capacitance between a gate electrode and a source electrode, and C_lc and C_gs are fixed values or constants.

The above technical solutions according to the present invention have the advantages effects as follows:

Input voltages having opposite polarities and the same absolute value are applied to the first data line and the second data line, so that when the first data line transfers a voltage signal having a first intensity to a pixel electrode via a thin film transistor (TFT), while the second data line transfers a voltage signal having a second intensity to the pixel electrode, the voltage signal having the first intensity and the voltage signal having the second intensity have the same quantity of electricity and opposite polarities. Therefore, the coupling capacitance produced by the first data line and the pixel electrode and the coupling capacitance produced by the second data line and the pixel electrode have the same absolute value. Since the voltage signal having the first intensity and the voltage signal having the second intensity have the opposite polarities, when a jump voltage caused by the first coupling capacitance produced by the first data line and the pixel electrode causes the voltage of the pixel electrode to increase, a jump voltage caused by the second coupling capacitance produced by the second data line and the pixel electrode causes the voltage of the pixel electrode to decrease. Therefore, the jump voltage caused by the first coupling capacitance and the jump voltage caused by the second coupling capacitance are counteracted (cancelled), so that the voltage of the pixel electrode becomes stable so as to avoid the phenomena that the jump voltage produced by the coupling capacitance between the data line and the pixel electrode leads to a non-uniform picture display.

The present invention will be more clearly understood from the description of preferred embodiments as set forth below, with reference to the accompanying drawings.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

In order to clearly set forth the technical problem to be solved by the present invention, the working principle provided by the present invention is elaborated firstly.

Figure 1:
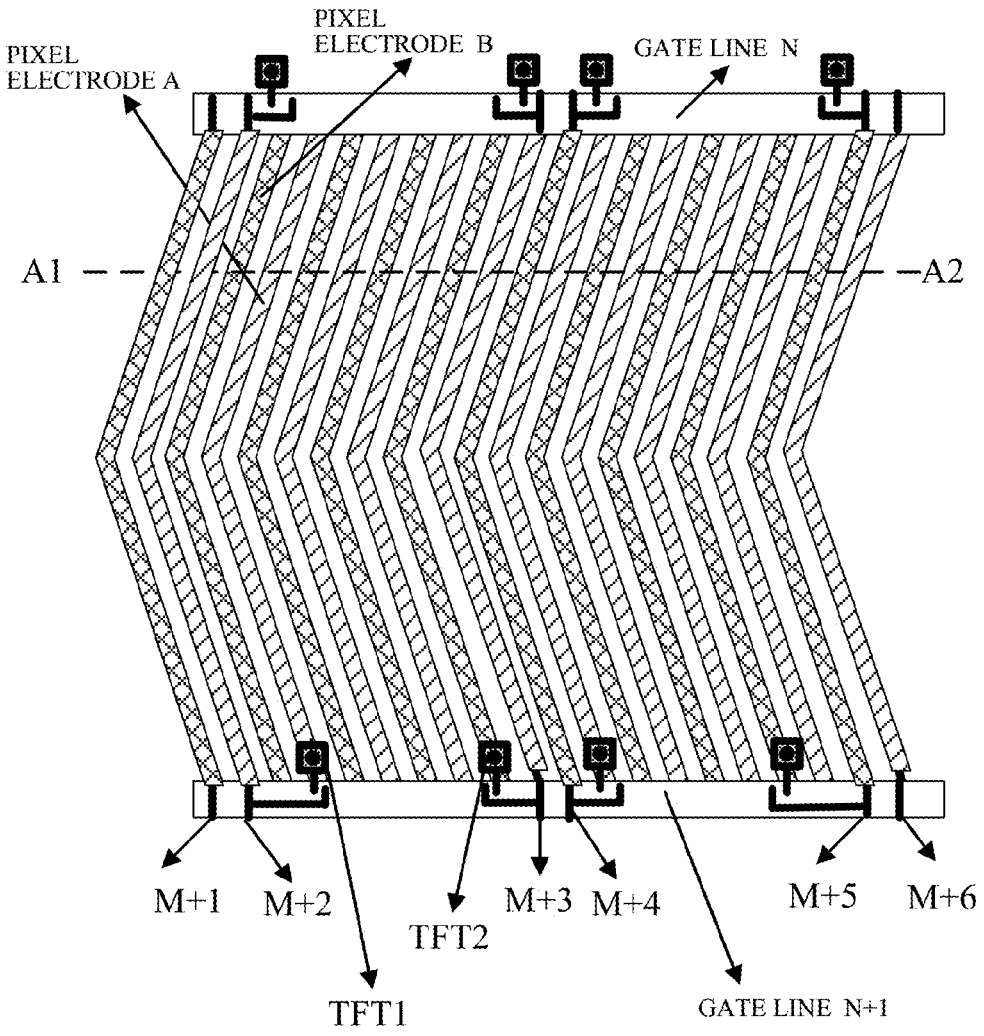
FIG. 1 is a plan diagram illustrating a pixel region of an array substrate in a TFT mode according to the present invention.

FIG. 1 is a plan diagram illustrating a pixel region of an array substrate in a TFT mode according to an embodiment of the present invention. The array substrate provided by the embodiment of the present invention comprises: a plurality of gate lines, a plurality of data lines, and pixel regions each of which (an illustrative pixel region is given in FIG. 1) is defined by intersecting one gate line and two neighboring data lines among the plurality of gate lines and the plurality of data lines (that is, a 1G2D structure). Here, the gate line and the data lines may vertically intersect each other to form a defined pixel region, or the data lines may be fold lines to intersect with the gate line to define pixel regions. Two thin film transistors (that is two TFTs) are formed in the intersection point of the gate line and the data lines within each pixel region. Pixel electrodes, including a first pixel electrode and a second pixel electrode, are alternately arranged in each pixel region. Here, the first thin film transistor (TFT1 as shown in FIG. 1) of the two thin film transistors is coupled to a first pixel electrode (the pixel electrode A above the first data line M+2). On the other hand, the second thin film transistor (TFT2 as shown in FIG. 1) is coupled to a second pixel electrode (the pixel electrode B nearby the second data line M+3). The two neighboring data lines within each pixel region comprise a first data line coupling to the first thin film transistor and a second data line coupling to the second thin film transistor. Voltages having opposite polarities and the same absolute value are applied to the first pixel electrode and the second pixel electrode via the first thin film transistor and the second thin film transistor respectively.

Here, when the distance between a certain data line and its adjacent pixel electrode is small, coupling capacitance will be generated between the data line and the pixel electrode. When the data line and the pixel electrode overlap, coupling capacitance is also generated. Input voltages having the opposite polarities and the same absolute value are applied to the first data line and the second data line, so that the first data line transfers a voltage signal having a first intensity to the first pixel electrode via the first TFT, the second data line transfers a voltage signal having a second intensity to the second pixel electrode via the second TFT. The voltage signal having the first intensity and the voltage signal having the second intensity have the same quantity of electricity and opposite polarities, so that the coupling capacitance produced by the first data line and the pixel electrode adjacent to or overlapped with the first data line and the coupling capacitance produced by the second data line and the pixel electrode adjacent to or overlapped with the second data line are the same. Since the voltage signal having the first intensity and the voltage signal having the second intensity have the opposite polarities, when a jump voltage caused by the first coupling capacitance produced by the first data line and the pixel electrode adjacent to or overlapped with the first data line enables the voltage of the pixel electrode to increase, while a jump voltage caused by the second coupling capacitance produced by the second data line and the pixel electrode adjacent to or overlapped with the second data line enables the voltage of the pixel electrode to decrease. The jump voltage caused by the first coupling capacitance and the jump voltage caused by the second coupling capacitance are counteracted so that the voltage of the pixel electrode becomes stable so as to avoid the phenomena that the jump voltage produced by the coupling capacitance between the data line and the pixel electrode leads to a non-uniform picture display.

As shown in FIGS. 1-4, the array substrate 10 comprises: gate lines N, N+1, data lines M+1, M+2, . . . M+6, wherein the gate line N, the gate line N+1 and two data lines (the first data line M+2 and the second data line M+3, or the first data line M+4 and the second data line M+5, and so on) define a pixel region. And two thin film transistors are formed at the intersection, that is a first thin film transistor TFT1 and a second thin film transistor TFT2.

Pixel electrodes are alternately arranged within each pixel region. As shown in FIGS. 1-4, the pixel electrode A and the pixel electrode B are alternately arranged. The first thin film transistor TFT1 of the two thin film transistors is coupled to the first pixel electrode (for example, the pixel electrode A above the first data line M+2), while the second thin film transistor TFT2 is coupled to the second pixel electrode (for example, the pixel electrode B above the second data line M+3).

Figure 3:
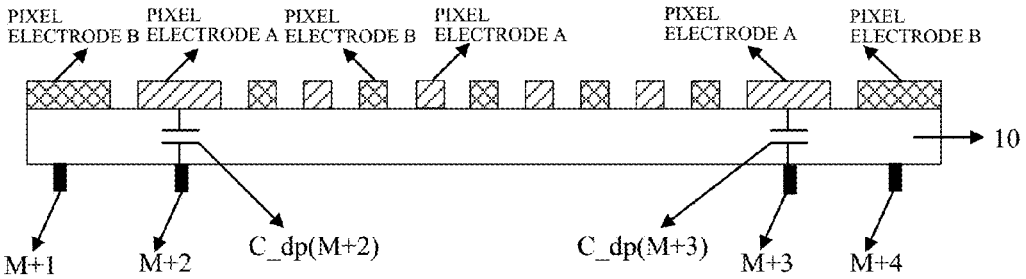
FIG. 3 is a cross section diagram showing the array substrate in the TFT mode in A1-A2 direction of FIG. 1.

FIG. 3 is a cross section diagram showing the array substrate in the TFT mode in A1-A2 direction of FIG. 1. FIG. 3 shows a pixel electrode A and a pixel electrode B. The first pixel electrode is the pixel electrode A above the first data line M+2, and the second pixel electrode is the pixel electrode B above the second data line M+3. The pixel electrode A is arranged above the two neighboring data lines or the pixel electrode B is arranged above the two neighboring data lines. And the pixel electrode A or the pixel electrode B covers an orthographic projection position above the two neighboring data lines. Specifically, the first pixel electrode is arranged above the first data line and the second data line; or the second pixel electrode is arranged above the first data line and the second data line. In summary, the same pixel electrode may be arranged above the first data line and the second data line, which is not limited. Furthermore, a width of the first pixel electrode or the second pixel electrode is larger than a width of the data lines. Preferably, the width of the first pixel electrode or the second pixel electrode is 6-12 μm larger than the width of the data lines.

Specifically, as shown in FIG. 3, the pixel electrode A (or pixel electrode B) is arranged above the data line M+2 and the data line M+3 respectively. The voltage signals having the same absolute value and opposite polarities are applied to the data line M+2 and the data line M+3. The voltage signals are applied to the pixel electrode A and the pixel electrode B via the first thin film transistor and the second thin film transistor (not shown in FIG. 3) respectively. The first coupling capacitance produced by the data line M+2 and the pixel electrode A as well as the second coupling capacitance produced by the data line M+3 and the pixel electrode A are the same. Since the voltage signal applied to the data line M+2 and the voltage signal applied to the data line M+3 have the opposite polarities, when a jump voltage caused by the first coupling capacitance produced by the data line M+2 and the pixel electrode A enables the voltage of the pixel electrode A to decrease, while a jump voltage caused by the second coupling capacitance produced by the data line M+3 and the pixel electrode A enables the voltage of the pixel electrode to increase. The jump voltages of the pixel electrode A caused by the first coupling capacitance and the second coupling capacitance are counteracted so that a sum voltage of the pixel electrodes between the data line M+2 and the data line M+3 becomes stable so as to avoid the phenomena that the jump voltage produced by the coupling capacitance between the data line and the pixel electrode leads to a non-uniform picture display.

Specifically, the above array substrate may further comprise: a gate line arranged above the substrate; a first insulating layer arranged above the gate line; a semiconductor layer arranged above the first insulating layer; a source and drain electrode layer and a data line layer arranged above the semiconductor layer, wherein the data line layer comprises a first data line and a second data line, the source terminal of the first thin film transistor is coupled to the first data line, the source electrode of the second thin film electrode is coupled to the second data line, a second insulating layer is arranged above the source and drain electrode layer and the data line layer; a pixel electrode layer arranged above the second insulating layer, wherein the first pixel electrode and the second pixel electrode is coupled to the drain terminal via a via-hole.

Preferably, a doped semiconductor layer is arranged between the semiconductor layer and the source and drain electrode layer so as to reduce a contact resistance between the semiconductor layer and the source and drain electrodes.

Furthermore, the second insulating layer may be made of a resin material so as to improve transmissivity. A resin layer is usually suitable to a large size product, such as TV.

According to the present embodiment of the present invention, the width of the first pixel electrode or the second pixel electrode is larger than the width of the data line so as to make the electric field (the electric field generated by the pixel electrodes A and B) at the edge of the pixel region (that is a region corresponding to the first data line and the second data line) stronger. In the prior arts, the electric field generated by a pixel electrode and a common electrode results in that liquid crystals rotate. The liquid crystal molecules adjacent to a data line are affected by the coupling capacitance produced between the data line and the common electrode so that the liquid crystal has an abnormal rotation.

According to the embodiment of the present invention, an electric field is generated between two pixel electrodes which are alternately arranged. Since the electric field in the whole pixel region is uniform, the liquid crystal does not have an abnormal rotation, especially in the pixel region adjacent to the data line. An electric field is also generated between the pixel electrode above the data line and another adjacent pixel electrode, so as to improve the efficiency of the liquid crystal therein and improve the transmissivity.

Another embodiment of the present invention also provides a display device, which comprises the array substrate stated above and a color substrate that is cell-aligned with the array substrate.

Figure 4:
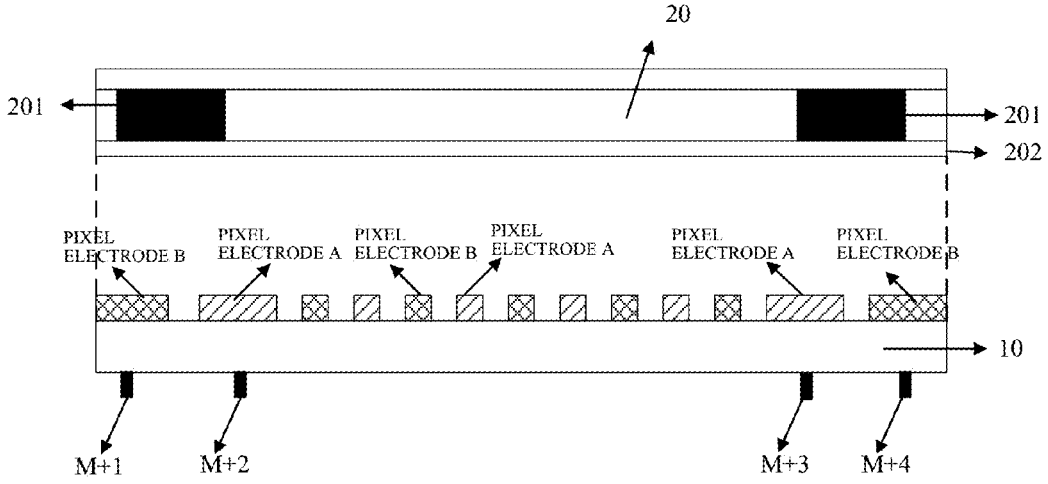
FIG. 4 is a profile diagram showing a display device in the TFS mode according to one embodiment of the present invention.

FIG. 4 shows a section diagram of the display device. In the above array substrate in the TFS mode according to the embodiment of the present invention, a common electrode (COM electrode) 202 is arranged on a color filter substrate 20 that is cell-aligned with the array substrate 10.

Furthermore, on the color filter substrate, a black matrix 201 is arranged with respect to a corresponding position above the data line, and the width of the black matrix 201 is 12-26 μm.

In the prior arts, the pixel electrode and the common electrode generate an electric field to drive the liquid crystal molecules to rotate. In the adjacent region of the data line, a coupling capacitance is generated between the pixel electrode and data line so that the liquid crystal has an abnormal rotation. Therefore, in the prior arts, the width of the black matrix is 22 μm so that the part where the liquid crystal has abnormal rotation is masked to make light not transmit. Therefore, abnormal picture caused by the abnormal rotation of the liquid crystal is not shown in the display. In the above structure according to the embodiment of the present invention, a pixel electrode is covered above the orthographic projected position of the data line; normal electrical fields are also generated in the pixel region close to an adjacent data line as well as between the pixel electrode above the data line and its another adjacent pixel electrode. When the efficiency of the liquid crystal is improved, the width of the black matrix is smaller than the width of a black matrix in the prior arts, and the liquid crystal is normally displayed and the display region is enlarged as compared with the prior arts. That is, according to the embodiment of the present invention, in the circumstance that the data line is overlapped or covered by the pixel electrode and the black matrix has a smaller width, there is a high aperture ratio and the display efficiency of the liquid crystal is improved.

Furthermore, in the above solution, the input voltages having the same absolute value and opposite polarities are applied to the first data line and the second data line, so that when the first data line transfers a signal having a first intensity to a pixel electrode via a TFT, the second data line transfers s signal having a second intensity to the pixel electrode, the voltage signal having the first intensity and the voltage signal having the second intensity have the same quantity of charges and opposite polarities. Therefore, the coupling capacitance generated by the first data line and a pixel electrode adjacent to or overlapped with the first data line as well as the coupling capacitance generated by the second data line and a pixel electrode adjacent to or overlapped with the second data line have the same absolute value. Since the voltage signal having the first intensity and the voltage signal having the second intensity have the opposite polarities, when a jump voltage caused by the first coupling capacitance produced by the first data line and the pixel electrode adjacent to or overlapped with the first data line enables the voltage of the pixel electrode to increase, a jump voltage caused by the second coupling capacitance produced by the second data line and the pixel electrode adjacent to or overlapped with the second data line enables the voltage of the pixel electrode to decrease. Thus, the jump voltage caused by the first coupling capacitance and the jump voltage caused by the second coupling capacitance are counteracted so that the voltage of the pixel electrode becomes stable so as to avoid the phenomena that the jump voltage produced by the coupling capacitance between the data line and the pixel electrode leads to a non-uniform picture display. Meanwhile, normal electric fields are also generated in the pixel region close to an adjacent data line as well as between the pixel electrode above the data line and another adjacent pixel electrode. When the efficiency of the liquid crystal is improved, a width of black matrix is smaller than a width of black matrix in the prior art. Thus, there is a high aperture ratio and the display efficiency of the liquid crystal is improved.

Figure 2:
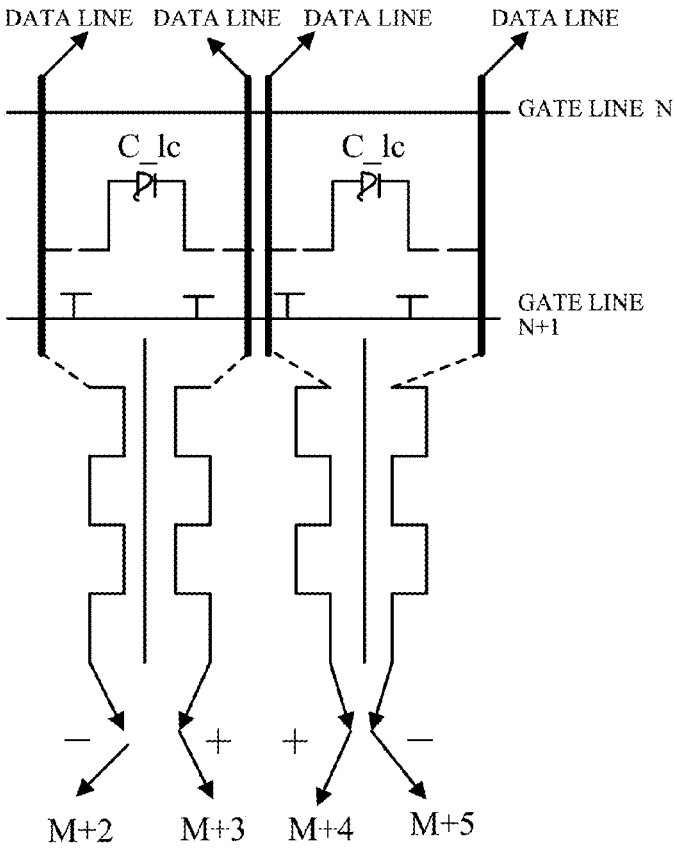
FIG. 2 is a schematic circuit diagram showing the pixel region in the TFT mode according to the present invention.

FIG. 2 shows a pixel driving method according to an embodiment of the present invention, which is applied to the above array substrate or display device. The method comprises:

Step 1, applying voltages having the same absolute value and opposite polarities to a first pixel electrode and a second pixel electrode respectively.

Specifically, Step 1 comprises:

Step 11, obtaining a first pixel voltage and a second pixel voltage used for display of the first pixel electrode and the second pixel electrode, wherein the first pixel voltage and the second pixel voltage have the same absolute value and opposite polarities;

Step 12, determining coupling capacitance generated by a data line and a pixel electrode;

Step 13, determining a first data line voltage and a second data line voltage to be inputted by the first data line and the second data line based on the first pixel voltage, the second pixel voltage determined in Step 11 and the coupling capacitance determined in Step 12;

Step 14, outputting the first data line voltage and the second data line voltage determined in Step 13 to the first data line and the second data line respectively via a driving IC;

Step 15, driving the first pixel electrode and the second pixel electrode via the first thin film transistor and the second thin film transistor in a pixel region respectively, based on the first data line voltage and the second data line voltage.

Here, the first data line and the second data line are the adjacent data lines in the pixel region. The first data line voltage and the second data line voltage have the same absolute value and opposite polarities.

The first data line voltage has the voltage signal of the data line M+2 as shown in FIG. 2. The second data line voltage has the voltage signal of the data line M+3 as shown in FIG. 2. Similarly, the same principle is also applicable to other pixel regions. In another pixel region, the voltage signal of the data line M+4 and the voltage signal of the data line M+5 have the same absolute value and opposite polarities. The polarities of the voltage signals between two adjacent data lines in the adjacent pixel regions are not limited. For example, the data line M+3 and the data line M+4 as shown in FIG. 2 may have the opposite polarities or the same polarity.

In another embodiment of the present invention, on top of above Steps 11-15, Step 12 comprises:

Step 121, determining a first coupling capacitance between the first data line and the first pixel electrode in the pixel region; specifically determining the first coupling capacitance based on a distance between the first data line and the first pixel electrode and the width of the first pixel electrode; and Step 122, determining a second coupling capacitance between the second data line and the second pixel electrode in the pixel region; specifically determining the second capacitance based on a distance between the second data line and the second pixel electrode and the width of the second pixel electrode.

Here, the first coupling capacitance and the second coupling capacitance may be determined based on the following equation:

$$\text{C_dp}(M+2) = \text{C_dp}(M+3) = \frac{\varepsilon S}{d}$$

Where C_dp(M+2) is the first coupling capacitance, C_dp (M+3) is the second coupling capacitance, ∈ is a dielectric constant, S is an area where a capacitor plate on which the first data line and the second data line are located is directly facing to a capacitor plate on which the first pixel electrode and the second pixel electrode are located, and d is a distance between the two capacitor plates.

In another embodiment of the present invention, on top of Step 11-15, Step 13 comprises:

Step 131, determining a first voltage jump value of the first pixel electrode which is caused by the first capacitance and between the first data line and the first pixel electrode;

Step 132, determining a second voltage jump value of the second pixel electrode which is caused by the second capacitance and between the second data line and the second pixel electrode;

Step 133, determining a total voltage jump value of the pixel electrodes based on the first coupling capacitance, the second coupling capacitance, the first voltage jump value and the second voltage jump value; and Step 134, determining the first data line voltage and the second data line voltage to be inputted by the first data line and the second data line based on the total voltage jump value of the pixel electrodes.

Where C_dp(M+2)=C_dp(M+3), C_dp(M+2) is the first coupling capacitance, C_dp(M+3) is the second coupling capacitance.

And ΔV(M+2)=−ΔV(M+3), wherein, if ΔV(M+2) is a voltage jump value which is increased for the first pixel electrode, and ΔV(M+3) is a voltage jump value which is decreased for the second pixel electrode and both of them have the same absolute value and opposite polarities.

In the above steps, the total voltage jump value of the pixel electrodes is determined based on the following equation:

$$Total\Delta VPixelVoltage = \frac{\text{C_dp}(M+2)}{\text{C_lc}+\text{C_gs}} \times \Delta V(M+2) + \frac{\text{C_dp}(M+3)}{\text{C_lc}+\text{C_gs}} \times \Delta V(M+3) = 0$$

Wherein, totalΔVPixelVoltage is the total voltage jump value of the pixel electrodes, C_dp(M+2) is the first coupling capacitance, C_dp(M+3) is the second coupling capacitance, C_lc is a liquid crystal capacitance, C_gs is a parasitic capacitance between a gate electrode and a source electrode.

Here, C_dp(M+2)=C_dp(M+3); for the same array substrate, C_lc and C_gs are fixed values or a constants. In addition, ΔV(M+2)=ΔV(M+3), wherein, if ΔV(M+2) is the voltage jump value which is increased for the first pixel electrode, ΔV(M+3) is the voltage jump value which is decreased for the second pixel electrode, both of them have the opposite polarities and the same absolute value of electrical quantity.

In the above embodiments of the present invention, taking the voltage of the common electrode 202 (COM electrode as shown in FIG. 4) of the array substrate as a reference, the first data line voltage of the first data line and the second data line voltage of the second data line have the same absolute value and opposite polarities.

According to the embodiments of the present invention, input voltages which have the same absolute value and opposite polarities are applied to the first data line and the second data line, so that when the first data line transfers a voltage signal having the first intensity to a pixel electrode via TFT, the second data line transfer a voltage signal having the second intensity to a pixel electrode. The voltage signal having the first intensity and the voltage signal having the second intensity have the same electrical quantity and opposite polarities.

Therefore, the first coupling capacitance C_dp(M+2) generated between the first data line and the pixel voltage and the coupling capacitance C_dp(M+3) generated between the second data line and the pixel electrode have the same absolute value.

Since the voltage signal having the first intensity and the voltage signal having the second intensity have the opposite polarities, when a jump voltage ΔV(M+2) caused by the first coupling capacitance produced between the first data line and the pixel electrode enables the voltage of the pixel electrode to increase, a jump voltage ΔV(M+3) caused by the second coupling capacitance produced between the second data line and the pixel electrode enables the voltage of the pixel electrode to decrease. The jump voltage caused by the first coupling capacitance and the jump voltage caused by the second coupling capacitance are counteracted, i.e., ΔV(M+2)+ΔV (M+3)=0, so that the voltage of the pixel electrode becomes stable so as to avoid the phenomena that the jump voltage produced by the coupling capacitance between the data line and the pixel electrode leads to a non-uniform picture display.

The present invention provides a display device, comprising the above array substrate. The display device may be a liquid crystal panel, an electrical paper, an OLED plate, a liquid crystal monitor, a digital photo frame, a cell phone, a tablet computer, or any product or component having display functionality. The display device provided in the present invention has the advantages of low power consumption and excellent picture quality.

The above mentioned are only the embodiments of the present disclosure, which is not intended to limit the protection scope of the present disclosure. Thus any change, alternative, and modification within the spirit and principle of the embodiment of the present disclosure should belong to the scope of protected by the present disclosure.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. An array substrate, comprising: a plurality of gate lines, a plurality of data lines, and pixel regions each of which is defined by intersecting one gate line and two neighboring data lines among the plurality of gate lines and the plurality of data lines;

wherein two thin film transistors (TFTs) are formed at the intersections between the gate line and the two neighboring data lines in each pixel region, a first pixel electrode and a second pixel electrode are alternately arranged in each pixel region;

wherein a first thin film transistor of the two thin film transistors is coupled to the first pixel electrode, a second thin film transistor of the two thin film transistors is coupled to the second pixel electrode;

wherein the two neighboring data lines participating in defining a pixel region comprise a first data line coupling to the first thin film transistor and a second data line coupling to the second thin film transistor; and wherein a first and a second pixel voltages having the same absolute value and opposite polarities are applied to the first pixel electrode and the second pixel electrode respectively via the first thin film transistor and the second thin film transistor;

wherein the first pixel electrode and the second pixel electrode are driven by the first thin film transistor and the second thin film transistor in each pixel region respectively, based on a first data line voltage and a second data line voltage;

wherein the first data line voltage and the second data line voltage are determined based on the first pixel voltage, the second pixel voltage, a coupling capacitance generated by the first data line and the first pixel electrode and a coupling capacitance generated by the second data line and the second pixel electrode.

2. The array substrate according to claim 1, wherein the first pixel electrode is arranged above the two neighboring data lines or the second pixel electrode is arranged above the two neighboring data lines, and the first pixel electrode or the second pixel electrode covers an orthographic projection position above the two neighboring data lines.

3. The array substrate according to claim 2, wherein the width of the first pixel electrode or the second pixel electrode is larger than the width of the first data line or the second data line.

4. The array substrate according to claim 3, wherein the width of the first pixel electrode or the second pixel electrode is 6-12 μm larger than the width of the first data line or the second data line.

5. A display device, comprising the array substrate as defined in claim 1 and a color filter substrate that is cell-aligned with the array substrate.

6. The display device according to claim 5, wherein a common electrode is further arranged on the color filter substrate that is cell-aligned with the array substrate.

7. The display device according to claim 6, wherein a black matrix is arranged at a corresponding position above the data lines on the color filter substrate; and wherein a width of the black matrix is 12-26 μm with respect to the corresponding position above the data lines.

8. A method for driving pixels within each pixel region of an array substrate; wherein the array substrate comprises: a plurality of gate lines, a plurality of data lines, and each pixel region is defined by intersecting one gate line and two neighboring data lines among the plurality of gate lines and the plurality of data lines;

wherein two thin film transistors (TFTs) are formed at the intersections between the gate line and the two neighboring data lines in each pixel region, a first pixel electrode and a second pixel electrode are alternately arranged in each pixel region; wherein a first thin film transistor of the two thin film transistors is coupled to the first pixel electrode, a second thin film transistor of the two thin film transistors is coupled to the second pixel electrode; wherein the two neighboring data lines participating in defining each pixel region comprise a first data line coupling to the first thin film transistor and a second data line coupling to the second thin film transistor; and wherein voltages having the same absolute value and opposite polarities are applied to the first pixel electrode and the second pixel electrode respectively via the first thin film transistor and the second thin film transistor; wherein the method comprises:

Step 1, applying voltages having the same absolute value and opposite polarities to the first pixel electrode and the second pixel electrode respectively;

wherein Step 1 comprises:

Step 11, obtaining a first pixel voltage and a second pixel voltage used for display of the first pixel electrode and the second pixel electrode, wherein the first pixel voltage and the second pixel voltage have the same absolute value and opposite polarities;

Step 12, determining a coupling capacitance generated by a data line and a pixel electrode;

Step 13, determining a first data line voltage and a second data line voltage to be inputted by the first data line and the second data line based on the first pixel voltage, the second pixel voltage and the coupling capacitance;

Step 14, outputting the first data line voltage and the second data line voltage determined in Step 13 to the first data line and the second data line via a driving circuit; and Step 15, driving the first pixel electrode and the second pixel electrode via the first thin film transistor and the second thin film transistor in a pixel region respectively, based on the first data line voltage and the second data line voltage.

9. The method for driving pixels according to claim 8, wherein Step 12 comprises:

Step 121, determining a first coupling capacitance between the first data line and the first pixel electrode in the pixel region, based on a distance between the first data line and the first pixel electrode and the width of the first pixel electrode; and Step 122, determining a second coupling capacitance between the second data line and the second pixel electrode in the pixel region, based on a distance between the second data line and the second pixel electrode and the width of the second pixel electrode.

10. The method for driving pixels according to claim 9, wherein in Step 121 or Step 122, the first coupling capacitance and the second coupling capacitance are determined by the following equation:

$$C_dp(M+2) = C_dp(M+3) = \frac{\varepsilon S}{d};$$

wherein C_dp(M+2) is the first coupling capacitance, C_dp(M+3) is the second coupling capacitance, ∈ is a dielectric constant, S is an area where a capacitor plate on which the first data line and the second data line are located is directly facing to a capacitor plate on which the pixel electrodes are located, and d is a distance between the two capacitor plates.

11. The method for driving pixels according to claim 8, wherein Step 13 comprises:

Step 131, determining a first voltage jump value of the first pixel electrode which is caused by the first coupling capacitance and between the first data line and the first pixel electrode;

Step 132, determining a second voltage jump value of the second pixel electrode which is caused by the second coupling capacitance and between the second data line and the second pixel electrode;

Step 133, determining a total voltage jump value of the pixel electrodes based on the first coupling capacitance, the second coupling capacitance, the first voltage jump value and the second voltage jump value; and Step 134, determining the first data line voltage and the second data line voltage to be inputted by the first data line and the second data line based on the total voltage jump value of the pixel electrodes.

12. The method for driving pixels according to claim 11, wherein C_dp(M+2)=C_dp(M+3), and AV(M+2)=−ΔV(M+3), wherein, if ΔV(M+2) is a voltage jump value which is increased for the first pixel electrode, and ΔV(M+3) is a voltage jump value which is decreased for the second pixel electrode and both the first pixel electrode and the second pixel electrode have the same absolute value and opposite polarities.

13. The method for driving pixels according to claim 11, wherein the total voltage jump value of the first pixel electrode and the second pixel electrode is determined based on the following equation:

$$Total\Delta VPixelVoltage = \frac{C_dp(M+2)}{C_lc + C_gs} \times \Delta V(M+2) + \frac{C_dp(M+3)}{C_lc + C_gs} \times \Delta V(M+3) = 0$$

wherein, totalΔVPixelVoltage is the total voltage jump value of the first pixel electrode and the second pixel electrode, C_lc is a liquid crystal capacitance, C_gs is a parasitic capacitance between a gate electrode and a source electrode, and C_lc and C_gs are fixed values or constants.

* * * * *